US007678995B2

(12) United States Patent
Hengel et al.

(10) Patent No.: US 7,678,995 B2
(45) Date of Patent: Mar. 16, 2010

(54) CONTACT DEVICE FOR PROVIDING AN ELECTRICAL CONTACT BETWEEN FLAT CURRENT CARRYING LINE ELEMENTS

(75) Inventors: Christian Hengel, Hochstatt (FR); Frederic Schull, Hagenbach (FR); Yannick Nurdin, Walheim (FR)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 12/111,086

(22) Filed: Apr. 28, 2008

(65) Prior Publication Data

US 2008/0271921 A1 Nov. 6, 2008

(30) Foreign Application Priority Data

Apr. 26, 2007 (EP) ..... 07405128

(51) Int. Cl.
*H01R 4/28* (2006.01)

(52) U.S. Cl. ..... 174/88 B

(58) Field of Classification Search ..... 174/88 B, 174/117 F; 439/213, 843, 845
See application file for complete search history.

(56) References Cited

U.S. PATENT DOCUMENTS 3,895,853 A 7/1975 Neidecker
4,013,329 A 3/1977 Hugin
4,174,143 A 11/1979 Hicks, Jr. et al.
5,029,254 A 7/1991 Stickney
5,588,884 A * 12/1996 Rudoy et al. ..... 439/845
6,365,297 B1 * 4/2002 Wolczak et al. ..... 429/159
6,485,337 B2 * 11/2002 Hsieh ..... 439/845

FOREIGN PATENT DOCUMENTS

EP 0568755 A1 11/1993
EP 1119077 A1 7/2001

* cited by examiner

*Primary Examiner*—Chau N Nguyen
(74) *Attorney, Agent, or Firm*—Browdy & Neimark, PLLC

(57) ABSTRACT

A contact device for providing an electrical contact between a first busbar (3) and a second busbar (4) which are arranged substantially parallel to each other, comprises a holder (2) with two sidewalls (21, 22) which extend substantially parallel. Said sidewalls (21, 22) enclose a slot (23) for receiving the second busbar. The sidewalls (21, 22) comprise an inner surface (211, 221) facing the slot (23) and an outer surface (212, 222). One sidewall (21, 22) is adapted to face the first busbar (3) with its outer surface (212, 222) and to face the second busbar (4) with its inner surface (211,221). Said sidewall (21) comprises a contact element (1) for providing an electrical contact through said sidewall (21) from the inner surface (211) to the outer surface (212).

28 Claims, 5 Drawing Sheets

CONTACT DEVICE FOR PROVIDING AN ELECTRICAL CONTACT BETWEEN FLAT CURRENT CARRYING LINE ELEMENTS

FIELD OF THE INVENTION

The invention relates to a contact device for providing an electrical contact between flat current carrying line elements, in particular between busbars.

PRIOR ART

Several devices to provide an electrical contact between flat current carrying line elements are known from prior art.

EP 0 568 755 for example shows a contact device to provide an electrical contact between overlapping busbars or flat plates. The contact device is arranged between a first busbar and a second busbar and comprises several contact modules that are arranged between said busbars. The first busbar is connected to the second busbar by means of a screw and a nut.

A further device for providing an electrical connection between busbars is shown in U.S. Pat. No. 4,174,143. Several U-shaped members are arranged in a parallel manner in order to receive a plurality of busbars. The U-shaped members comprise two openings to receive a first and a second busbar that are arranged in a collinear direction.

The current flow in the busbars is more or less parallel to busbars and equally distributed over their whole width. However, in the region of the screw and the nut the current flow is concentrated due to the reduction of the cross sectional surface and the presence of the screw. Such a concentration of the current and inductive effects leads to magnetic losses. Especially with currents having a high frequency such losses have negative effects.

SUMMARY OF THE INVENTION

An object of the present invention is to provide a contact device for providing an electrical contact between flat current carrying line elements, such as busbars, which does not have the disadvantages according to devices of prior art. In particular such a contact device shall minimize the magnetic losses of the contact zone.

This object is achieved by a contact device having the features of claim 1. Accordingly a contact device for providing an electrical contact between a first busbar and a second busbar which are arranged substantially parallel to each other, comprises a holder with two sidewalls which extend substantially parallel. Said sidewalls enclose a slot for receiving the second busbar. The sidewalls comprise an inner surface facing the slot and an outer surface. One sidewall is adapted to face the first busbar with its outer surface and to face the second busbar with its inner surface. Said sidewall comprises a contact element for providing an electrical contact through said sidewall from the inner surface to the outer surface and thus between the first busbar and the second busbar.

Without the use of screws and with a constant cross section through which the current is transmitted, the magnetic losses can be reduced significantly. Furthermore such a contact device can be attached to the busbar very easily without the use of further tools or equipment. Hence the contact device according to the present invention can be clipped onto a busbar very easily.

Preferably the contact element protrudes above and over the inner surface and/or above and over the outer surface of said at least one sidewall, i.e. said contact element extends into the slot and over the outer surface.

Due to the protrusion of the contact element, the contact device is able to establish a secure and reliable connection between said busbars.

Preferably the contact element comprises resilient moveable contact members which protrude over and above the inner surface and/or over the outer surface. If said contact members actually contact a busbar, the surface of the busbar usually contacts the surface of the outer or inner sidewall, hence the contact members do, if the busbar are contacted, not necessarily extend over the inner surface and/or outer surface. However in a disconnected state, i.e. without a contact to a busbar, said contact members normally extend over the inner surface and/or over the outer surface.

Said resilient member provide a force against the busbar and enhance the reliability of the electrical connection.

Preferably the holder is electrically insulating and comprises means to accommodate said contact element. Preferably the holder is made of plastic or fibre-reinforced plastics, wherein polyethylene, polyamide, polyetheretherketone (PEEK) or polyoxymethylene (POM) are suitable plastics.

Preferably said means to accommodate said contact element is a rectangular opening in the contact section which rectangular opening comprises grooves in order to receive the contact element.

Preferably the contact element comprises numerous separate, identical spring-mounted individual elements that are arranged essentially parallel to each other. Said spring-mounted individual elements are secured to a carrier band. Preferably said individual elements are interlaced contact bridges. The carrier band comprises guide brackets that extend sideways from the carrier band. Preferably the groove of the rectangular opening is able to receive said at least parts of said guide brackets or other parts of the contact element.

Further embodiments of the present invention are outlined in the dependent claims.

BRIEF DESCRIPTION OF THE DRAWINGS

The drawings will be explained in greater detail by means of a description of an exemplary embodiment, with reference to the following figures.

DETAILED DESCRIPTION OF THE PREFERRED EMBODIMENTS

With reference to the drawings possible embodiments are described. The drawings and the description illustrate preferred embodiments and shall not be construed to limit the invention, which is defined by the claims.

Figure 1:
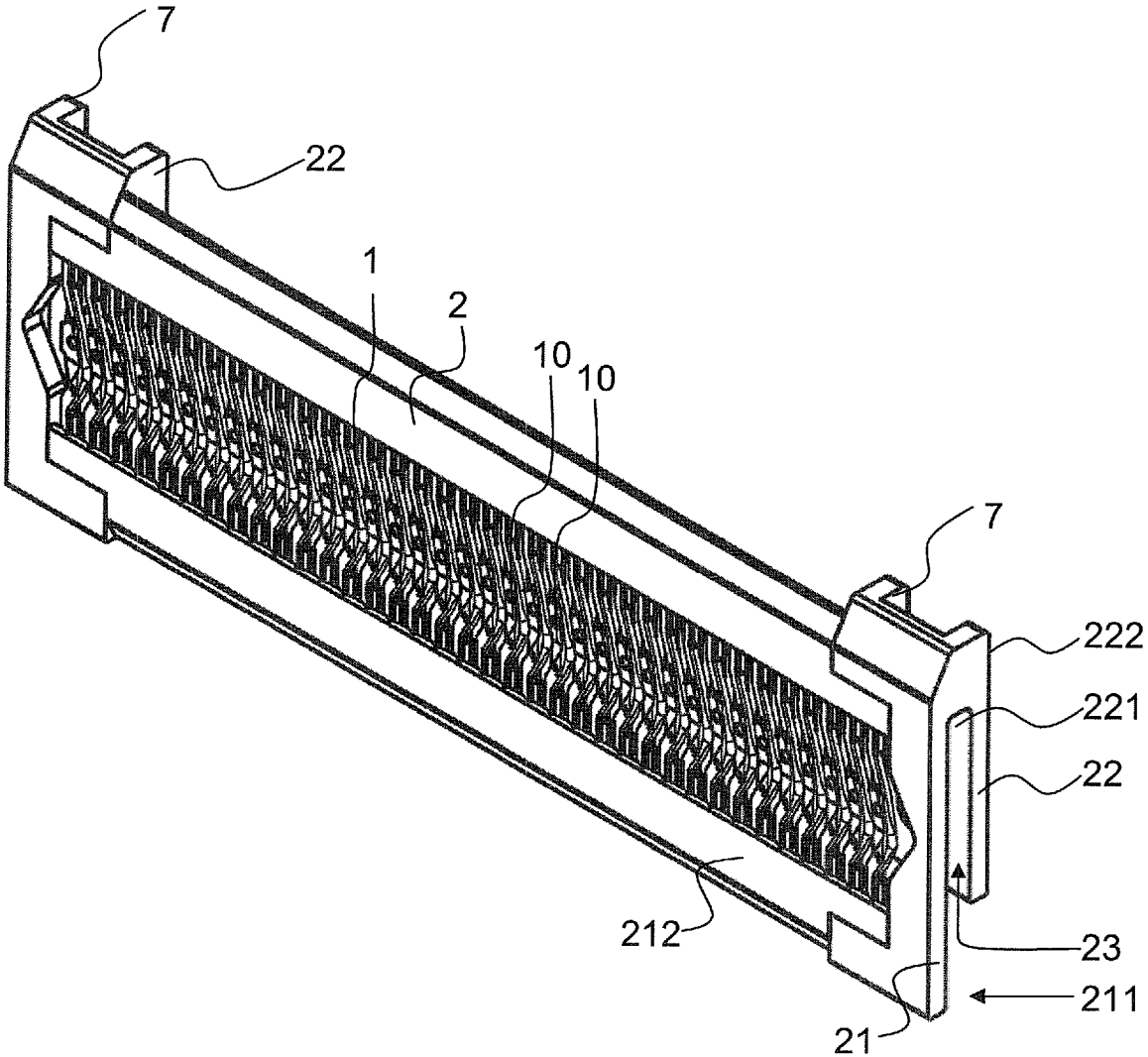
FIG. 1 shows a perspective of a contact device according to the present invention.

FIG. 1 shows a contact device for providing an electrical contact between a first busbar and a second busbar (not shown in the drawing) according to present invention in a perspective view. Typically said first and said second busbar are substantially parallel to each other. However, the term busbar shall include flat current carrying line elements. Typically such busbars have a thickness between 1 mm and 10 mm and a width between 25 mm and 200 mm. The cross section is preferably rectangular.

The contact device according to the present invention comprises a contact element 1 for providing an electrical contact between said busbars and a holder 2 to accommodate the electrical contact element 1.

Figure 5:
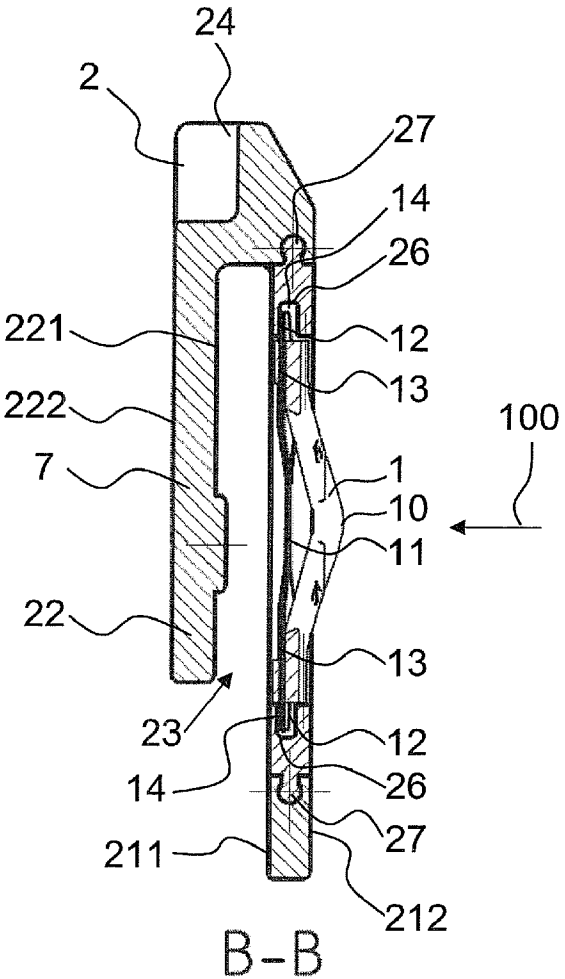
FIG. 5 shows a cross-sectional view along the section line B-B of FIG. 3.
Figure 4:
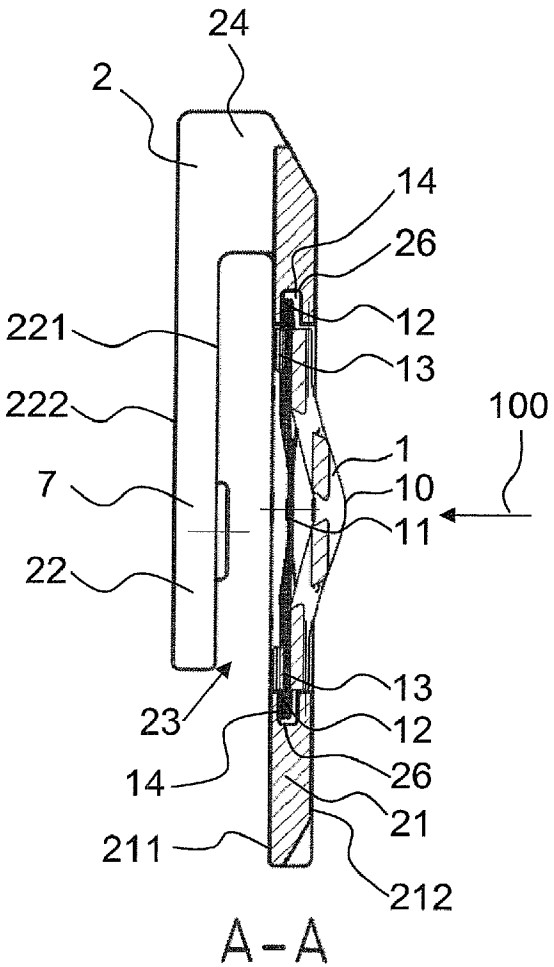
FIG. 4 shows a cross-sectional view along the section line A-A of FIG. 3.

The contact element 1 is shown in FIG. 1 as well as in FIG. 4 or 5. The contact element 1 comprises numerous separate, identical spring-mounted individual elements 10, which may also be designated as interlaced contact bridges. The contact bridges 10 are arranged essentially parallel to each other. A carrier band 11 extends along a longitudinal axis and the contact bridges 10 are secured to the carrier band 11. Guide brackets 12 extend sideways from the carrier band 11.

In a first embodiment the contact bridges 10 can be mounted directly to the carrier band 11, wherein parts of the contact bridges 10 encompass or enclose the carrier band 11 at least partially. Hence the contact bridges 10 extend above and below the carrier band 11.

Alternatively in a second embodiment the contact bridges 10 comprise a forming zone 13 at their two ends in order to encompass the guide brackets 12 at least partially. Preferably the encompassment is in a region close to the carrier band 11 so that the guide brackets still comprise a free end 14 in order to provide guidance. Due to the encompassment of the guide brackets 12 some parts of the contact bridges 10 extend below and above from the carrier band 11.

The extension of the contact bridges 10 on both sides of the carrier band 11, i.e. above and below, has the advantage that an electrical contact can be provided by the contact bridge 10 itself, since parts of the contact bridges 10 protrude over the carrier band 11. The carrier band 11 is therefore present to provide a carrier for the contact bridges 10. Furthermore said carrier band 11 and its guide brackets 12 act also as a spring or torsional element for the contact bridges 10. Therefore the contact bridges 10 are subjected to a resilient force in order to be placed in their original position after a contact with a busbar.

Such a contact element 1 is known from EP 1 119 077. Herewith the technical teaching according to EP 1 119 077 is incorporated by reference. Other contact elements known having similar features or a similar function can also be used.

However, in other embodiments the carrier band 11 of the contact element 1 can also be used to as an electrical transmitting element. Such an element is for example disclosed in U.S. Pat. No. 3,895,853.

The holder 2 comprises two sidewalls 21, 22. Both of which extend in the same direction and substantially parallel from a bridge element 24. The sidewalls 21, 22 enclose a slot 23. With other words the slot 23 is provided by the sidewalls 21, 22. The slot 23 is arranged for receiving a busbar, preferably a second busbar. Preferably the holder 2 is made of electrically insulating material such as plastics or fibre-reinforced plastics, wherein polyethylene, polyamide, polyetheretherketone (PEEK) or polyoxymethylene (POM) are suitable plastics.

The sidewalls 21, 22 comprise an inner surface 211, 221 that faces the slot 23. Hence the inner surfaces 211, 221 face and contact the surface of a second busbar that is arranged in the slot 23. If no busbar is present in the slot 23 the inner surfaces 211, 221 face each other directly.

Furthermore the sidewalls 21, 22 comprise outer surfaces 212, 222. Said outer surfaces 212, 222 are arranged on that side of the sidewalls 21, 22 which is opposite of the inner surfaces 211, 221. The outer surface 212, is able to be contacted by a first busbar. This means that if the contact device according to the present invention is arranged within a busbar assembly the outer surface 212, faces said first busbar which is not located within the slot 23. The outer surfaces 212, 221 are provided to hold the insulating carrier 2 in the busbar assembly.

In the embodiment according to FIG. 1 the contact element 1 is arranged in the sidewall 21. Said sidewall may also be designated as contact sidewall. The other sidewall 22 without the electrical contact element is formed as a clip sidewall or clip element. Preferably the sidewall 21 with the contact element 1 is longer than the sidewall 22 without the contact element 1. The sidewall 21 with contact element is designed such to carry the flexible contact element and to avoid a compression of the flexible contacts under a minimal measure or gap that would wear out the flexibility or resilience of the contact element.

The holder 2 can either be provided as one single piece or as group of several single pieces as explained with FIG. 5. Preferably the holder 2 is made out of plastic, so that an injection die molding method can be used. Alternatively or additionally a machining method can also be used. If the complete holder 2 is provided as one single piece it is possible to use an injection die molding method, wherein the contact element 1 can be placed in the die before plastic is injected.

Since the contact element 1 is encompassed by the holder 2 the contact element 1 is protected by the holder 2 against mechanical influences.

Figure 2:
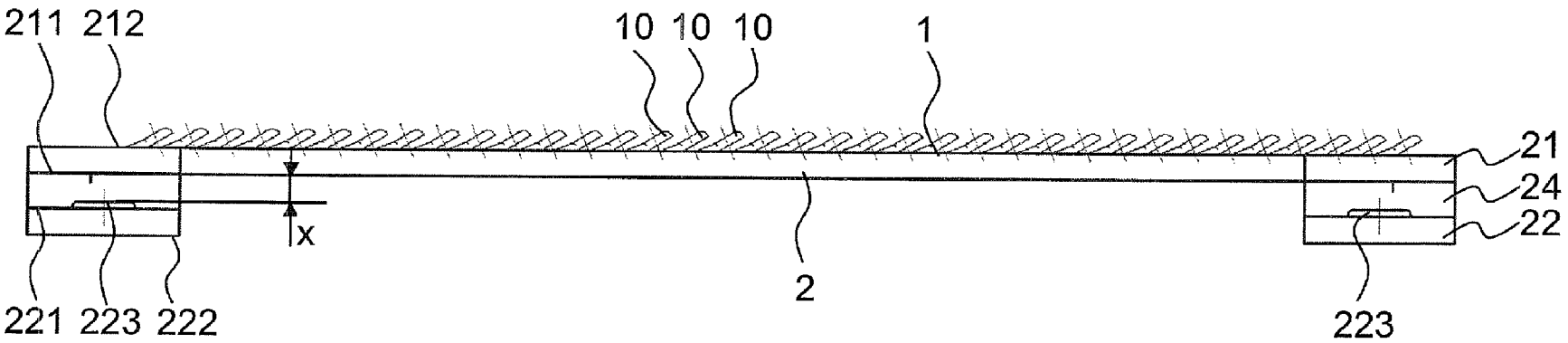
FIG. 2 shows a side view of the contact device according to FIG. 1.

FIG. 2 shows a side view of the contact device according to present invention. The contact bridges 10 of the contact element 1 protrude over and above the outer surface 212 of the contact sidewall 21. If the contact bridges 10 contact a busbar said contact bridges 10 will be deflected in direction of and towards the outer surface 212 of the contact sidewall 21. However it is also possible to arrange the contact element 1 within said sidewall 21 in an inverted way, i.e. the contact bridges 10 protrude over and above the inner surface 211. Preferably only some parts such as the tips of the contact bridges 10 of the contact element 1 extend or protrude over and above said outer surface 212 or said inner surface 211 respectively.

The clip element 22 comprises on its inner surface 221 a cam or bulge 223. The bulge 223 is cylindrically shaped and extends from the inner surface 221 into the slot 23. Therefore it reduces the width of the slot 23. The width X of the slot 23 is defined as the smallest clearance of the slot 23 as viewed in the direction of the slot 23. Preferably said width X is smaller than the width of the busbar to be received by the slot 23. This is particularly advantageous, because in a mounted state a force from the clip section results on the busbar, therefore said structure does not loosen itself e.g. due to vibrations. The bulge 223 avoids that the contact device according to the present invention slides on the busbars. The width X of the slot 23 can easily be adjusted to the width of the busbar.

The clip element 22 or the sidewall 22 is connected to the sidewall 21 with the contact element 1 via a bridge element 24. Preferably said bridge element 24 is resilient or elastically bendable. Due to the resilient properties the clip element 22 and the sidewall 21 provide a force in direction perpendicular to its inner surface. Once a busbar is arranged in the slot 23 said force provides a retention force. However, in other embodiments it is also possible to provide the clip element 22 itself with resilient properties. Preferably the clip element 22 is shorter than the sidewall 21 with the contact element 1 as viewed from the bridge element 24. However in other embodiments the clip element 22 is longer or equal than the sidewall 21.

In the present embodiment there are two clip elements 22 arranged. Said clip elements have a length that is shorter than the length of the sidewall 21 with the contact element 1. In other embodiments said clip element extends over the whole length of the sidewall 21 with the contact element 1. However, it is also possible to provide more than two clip elements 22 or one clip element 21 having a length that is shorter than the length of the sidewall 21 with the contact element 1.

Figure 3:
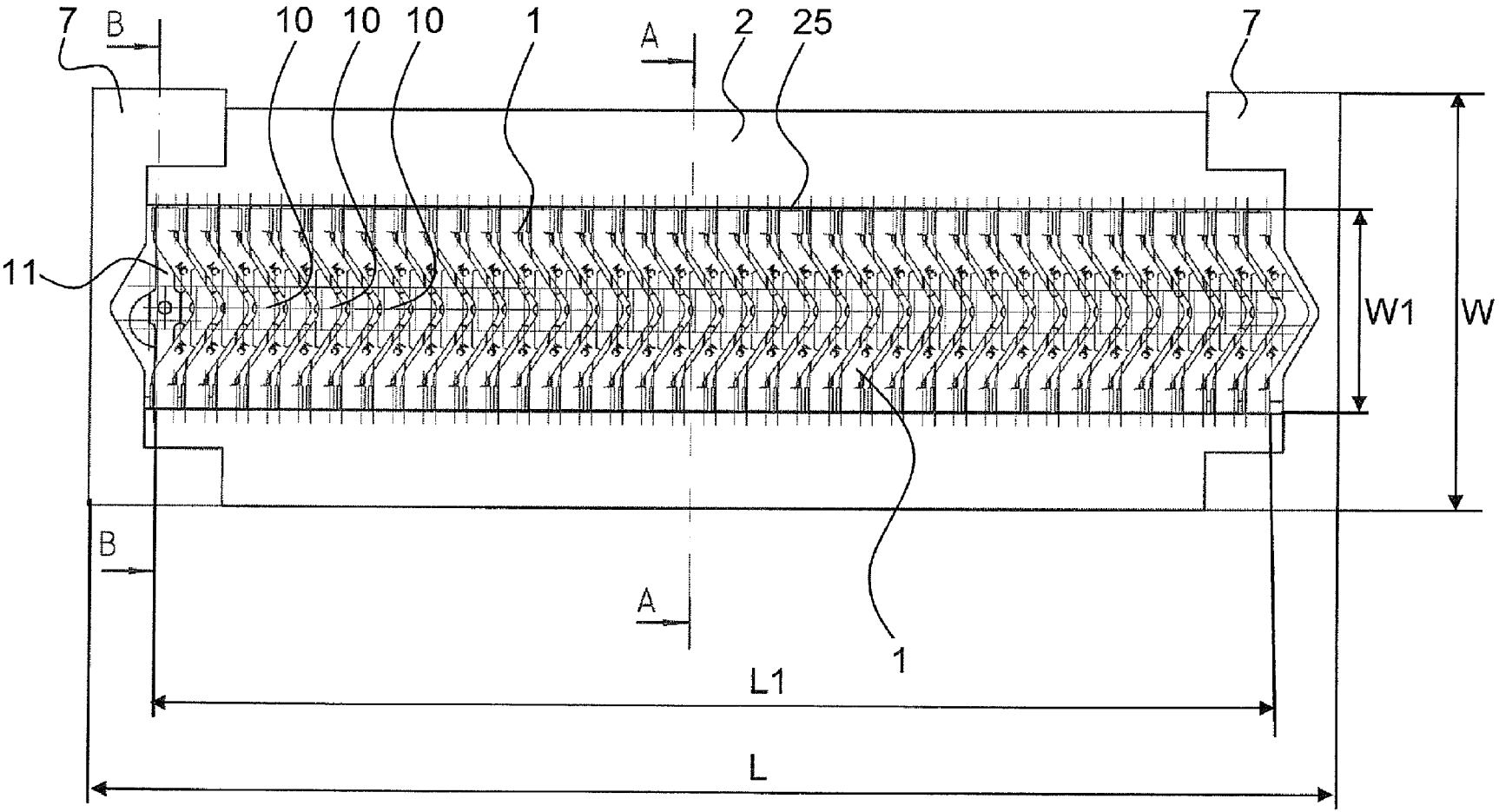
FIG. 3 shows a plan view of the contact device according to FIGS. 1 and 2.

FIG. 3 shows a plan view of the contact device according to the present invention. Since the contact element 1 is arranged in a rectangular opening 25 in the holder 2, the contact element 1 is completely surrounded by the holder 2.

As it can be seen the holder 2 has a length L and a width W. Preferably the length L is between 20 mm and 500 mm. The width W is preferably between 20 mm and 150 mm. The rectangular opening 25 has a length L1 and width W1. Preferably the length L1 is between 15 mm and 480 mm. The width W is preferably between 10 mm and 130 mm. Preferably the contact element 1 that is arranged within the holder 2 extends over the whole surface of the rectangular opening 25. This means that part of the contact element that visible from outside (i.e. through the rectangular opening) extends over the whole surface of the rectangular opening 25, hence the contact element 1 extends over the whole length L1 and over the whole width W1. It is an advantage of the present invention that the length is variable so that the length contact device may be adjusted to its use, e.g. to the current that is being transmitted etc.

FIG. 4 shows a section view along the section line A-A as indicated in FIG. 3 of the contact device according to the present invention. In this view it is clearly visible that one of the sidewalls in that case sidewall 21 is able to provide an electrical contact from the inner surface 211 to the outer surface 212 by means of the contact element 1.

In the cross sectional view A-A the accommodation of the contact element 1 within the holder 2 is visible. The rectangular opening 25 comprises grooves 26 extending along its longer edges. Said grooves 26 are able to accommodate the parts of the carrier band 11. In particular said grooves 26 receive the guide brackets 12 or the free ends of the guide brackets 12 of the contacting element 1. Preferably only the outermost portion of the guide brackets 12 extend into the groove 26. However, it is in an alternative embodiment also possible to provide the shorter edge of the rectangular opening 25 with grooves 26.

Also in that sectional view it is visible that parts of the contact element 1 protrude over the inner surface 211 and/or the outer surface 212 of the sidewall 21. In that embodiment the contact bridges 10, i.e. the tips of the contact bridges 10, protrude over the outer surface 212 and the forming zone 13 protrudes over the inner surface 211. If the contact element 1 is arranged reverse, the contact bridges 10 protrude over the inner surface 211 and the forming zone 13 protrudes over the outer surface 212.

FIG. 5 shows a cross sectional view taken along the section line B-B of FIG. 3. In this embodiment the clip element 22 and the bridge element 24 are formed integrally. This means that clip element 22 and the bridge element 24 are one single piece which can be designated as clip piece 7. Consequently, the sidewall 21 comprising the contact element 1 is also a single piece. The clip piece 7 can be connected to the sidewall 21 with the contact element 1 by a latch connection 27. Preferably two clip pieces 7 are arranged on both sides of the sidewall 21 with the contact element 1. This means that the clip pieces 7 provide the clip element 22 and the bridge element 24 as well as a mechanical stop or abutment for the contact element 1 that is arranged in the grooves 26.

In the cross sections according to FIGS. 4 and 5 one is also able to recognize that an electrical contact is provided through the sidewall 21 which comprises the contact element. When the contact bridge 10 is in contact with a busbar which is arranged so that it faces the outer surface 212 of said sidewall, the contact bridge 10 will be moved in direction of and towards the outer surface 212. This is indicated by arrow 100. Thereby the contact bridge 10 contacts the surface of the busbar facing the outer surface 212.

Parts of the contact bridge 10 that extend below the carrier band 11, i.e. in direction of the inner surface 211 protrude over the inner surface 211. If a busbar is arranged in the slot 23, an electrical contact between said parts of the contact bridge 10 and the busbar is established.

This means that the contact element 1, in particular the contact bridges 10 provide an electrical contact between the first busbar that is arranged on the outer side 212 of the sidewall 21 comprising the contact element 1 and the second busbar that is arranged in the slot 23. In other words, an electrical contact is provided from the outer surface 212 to the inner surface 211 or vice-versa through the sidewall 21.

With such a contact device according to the present invention the magnetical losses of a connection between two busbars may be reduced up to 25% in respect to contact device as known from prior art, e.g. the ones using screws to provide an electrical contact.

Figure 7:
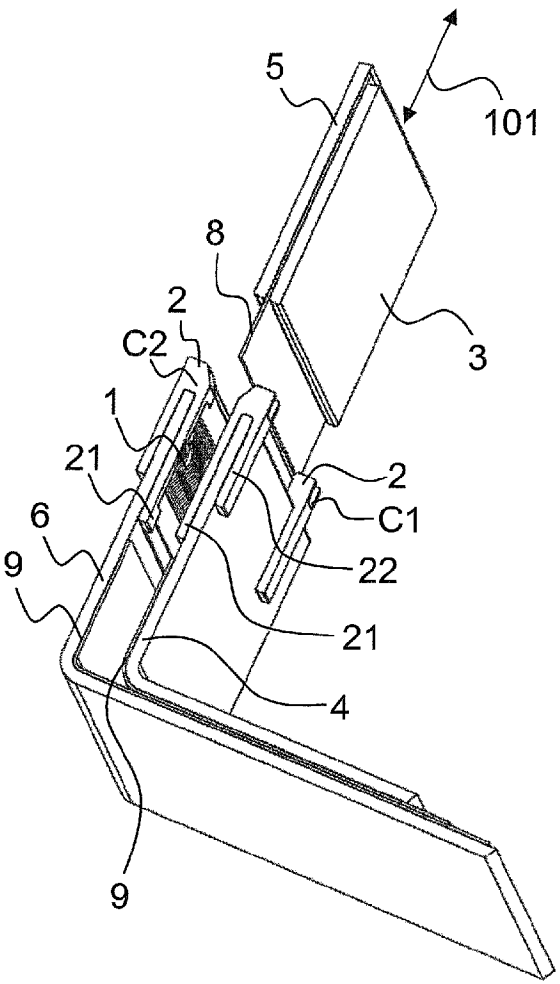
FIG. 7 shows the busbar arrangement of FIG. 6 in a disconnected stage.
Figure 6:
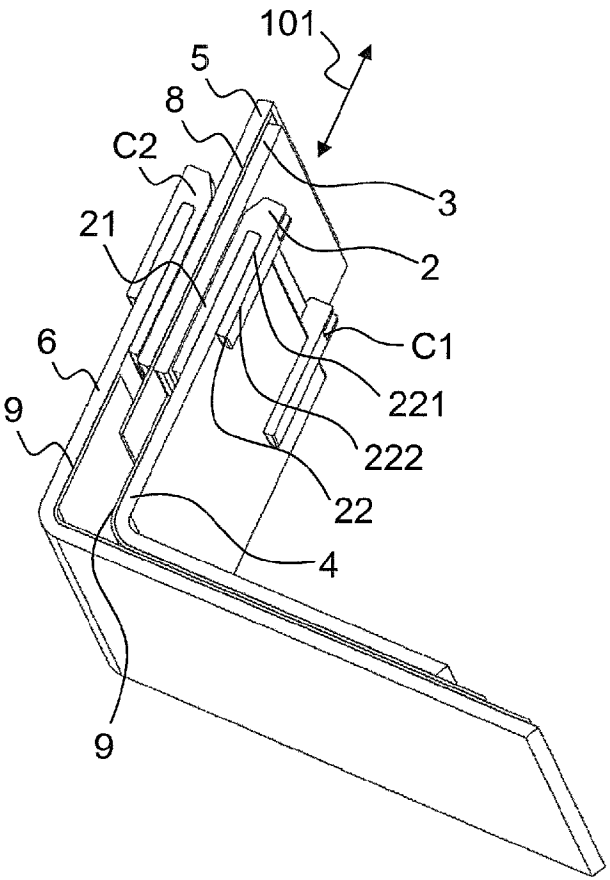
FIG. 6 shows a bipolar busbar arrangement with connected busbars.

FIG. 6 shows a perspective view of a bipolar busbar arrangement in a connected state and FIG. 7 shows a perspective view of said arrangement in a disconnected state. Said busbars are connected by a contact device according to the present invention. However, a contact device can also be used for a unipolar busbar arrangement.

The bipolar busbar arrangement comprises four busbars in order to transmit currents having different potentials. A first busbar 3 and a second busbar 4 are connected by a contact device C1. A third busbar 5 and a fourth busbar 6 are connected by a contact device C2. Preferably all of the busbars 3, 4, 5, 6 extend in the contact region substantially parallel to each other. In particular these busbars which will either be connected by the first contact device C1 or the second contact device C2 extend substantially parallel to each other. This means in the present embodiment that the first busbar 3 is substantially parallel to the second busbar 4 and that the third busbar 5 is substantially parallel to the fourth busbar 6.

The first busbar 3 and the second busbar 4 as well as the third busbar 5 and the fourth busbar 6 are arranged with respect to each other so that there is a gap between the first busbar 3 and the second busbar 4 or the third busbar 5 and the fourth busbar 6, respectively. Thereby said gap has a width such that sidewall 21 with the contact element 1 of the contact device C1 or C2 can be placed within said gap.

As it can be seen from the drawings the second busbar 4 extends into the slot 23 of the first contact device C1. Thereby the busbar faces the inner surface 211, 221 and contacts parts of the contact element 1. Hence an electrical contact between the contact element 1 and the second busbar 4 is established. The first contact device C1 is arranged such that the sidewall 21 with the contact element 1 faces the first busbar 3. This means that the outer surface 212 faces the first busbar 3.

As it can be seen from the drawings the first busbar 3 is moveable with respect to the second busbar 4. This illustrated by arrow 101. With a movement of the first busbar 3 with respect to the second busbar 4 the first busbar 3 impinges on the contact bridges 10 of the contact element 1. Since said contact bridge 10 is arranged angular or tilted to the direction of said movement, said contact bridge 10 will be displaced towards the outer surface 212 of the sidewall 21 with the contact element 1. As soon as the contact bridge 10 touches the surface of the first busbar 3 an electrical contact between the contact element 1 and the first busbar 3 is established. Since there is already an electrical contact between the second busbar 4 and the contact element 1, the first busbar is electrically connected to the second busbar 4 via the contact element 1. With other words, an electrical contact is provided through the sidewall 21 that is arranged between the first busbar 3 and the second busbar 4 due to the arrangement of the contact element 1 in said sidewall.

In order to connect the third busbar 5 to the fourth busbar 6 the same as just explained can be applied.

In this embodiment the first busbar 3 and the third busbar 5 are moveable with respect to the second busbar 4 and the fourth busbar 6. This means that the contact devices C1, C2 will be arranged on the second busbar 4 and on the fourth busbar 6. Alternatively it is also possible to have static busbars and that the contact devices are insertable in order to provide an electrical contact between said busbars.

As it can be seen in FIGS. 6 and 7 the first busbar 3 and the third busbar 5 are arranged parallel to each other. A insulating layer 8 is arranged between the first busbar 3 and the second busbar 4. Further insulating layers 9 are arranged between the second busbar 4 and the fourth busbar 6.

If a unipolar busbar arrangement shall be provided it is possible to omit one pair of the busbars.

In a further embodiment that is not shown in the drawings it is possible to arrange more than one contact element in the holder.

A method for providing an electrical contact between a first busbar 3 and a second busbar 4 with a contact device according to the present invention comprises the steps of:

- orient the contact device with respect to busbars so that the sidewall 21 with the contact element 1 is positioned between the first busbar 3 and the second busbar 4,
- arrange the contact device according to present invention on the second busbar 4, so that the slot 23 of the contact device receives said second busbar 4, i.e. shift the contact device onto the second busbar 4;
- move the first busbar 3 towards the contact device according to the present invention so that the contact element 1 contacts the surface of the first busbar 3.

In case the first busbar 3 is not moveable with respect to the second busbar 4 the last step of the described method is superfluous.

If the electrical contact between the first busbar and the second busbar shall be interrupted the above described method can be applied in reversed order.

LIST OF REFERENCE NUMERALS

1 contact element
2 holder
3 first busbar
4 second busbar
5 third busbar
6 fourth busbar
7 clip element
8 insulating layer
9 insulating layer
10 contact bridge elements
11 carrier band
12 guide brackets
13 forming zone
14 free end
21 sidewall/contact sidewall
22 sidewall/clip element
23 slot
24 bridge element
25 rectangular opening
26 grooves
27 latch connection
211 inner surface
212 outer surface
213 rectangular opening
221 inner surface
222 outer surface

The invention claimed is:

1. A contact device for providing an electrical contact between a first busbar and a second busbar which are arranged substantially parallel to each other, said contact device comprising:

- a holder with first and second sidewalls which extend substantially parallel to each other,
- wherein said sidewalls enclose a slot for receiving the second busbar,
- wherein each of the sidewalls comprises an inner surface facing the slot and an outer surface,
- wherein the first sidewall configured to face the first busbar with its outer surface and to face the second busbar with its inner surface, and comprises a contact element for providing an electrical contact through said first sidewall from the inner surface to the outer surface thereof, and
- wherein the holder is electrically insulating and comprises means to accommodate said contact element.

2. A contact device according to claim 1, wherein the contact element protrudes over the inner surface and/or over the outer surface of said first sidewall.

3. A contact device according to claim 1, wherein the contact element comprises resilient moveable contact members which protrude over the inner surface and/or over the outer surface.

4. A contact device according to claim 1, wherein the two sidewalls are connected by a bridge element, wherein said bridge element is resilient.

5. A contact device according to claim 1, wherein the width of the slot is smaller than or equal to the width of the second busbar that is placed in the slot.

6. A contact device according to claim 1, wherein the contact element is accommodated in a rectangular opening being arranged in said first sidewall.

7. A contact device according to claim 1, wherein said rectangular opening comprises grooves configured to receive the contact element.

8. A contact device for providing an electrical contact between a first busbar and a second busbar which are arranged substantially parallel to each other, said contact device comprising:

- holder with first and second sidewalls which extend substantially parallel to each other,
- wherein said sidewalls enclose a slot for receiving the second busbar,
- wherein each of the sidewalls comprises an inner surface facing the slot and an outer surface,
- wherein the first sidewall is configured to face the first busbar with its outer surface and to face the second busbar with its inner surface, and comprises a contact element for providing an electrical contact through said first sidewall from the inner surface to the outer surface thereof, and wherein said contact element is accommodated in a rectangular opening arranged in the first sidewall.

9. A contact device according to claim 8, wherein the contact element protrudes over the inner surface and/or over the outer surface of said first sidewall.

10. A contact device according to claim 8, wherein the contact element comprises resilient moveable contact members which protrude over the inner surface and/or over the outer surface.

11. A contact device according to claim 8, wherein the first and second sidewalls are connected by a resilient bridge element.

12. A contact device according to claim 8, wherein the width of the slot is smaller than or equal to the width of said second busbar that is placed in the slot.

13. A contact device according to claim 8, wherein said rectangular opening comprises grooves configured to receive the contact element.

14. A contact device for providing an electric contact between a first busbar and second busbar which are arranged substantially parallel to each other, said contact device comprising:

a holder with first and second sidewalls which extend substantially parallel to each other, wherein said sidewalls enclose a slot for receiving the second busbar;

wherein each of the sidewalls comprises an inner surface facing the slot and an outer surface, wherein the first sidewall is configured to face the first busbar with its outer surface and to face the second busbar with its inner surface, and comprises a contact element for providing an electrical contact through said first sidewall from the inner surface to the outer surface thereof, wherein the contact element comprises a plurality of separate and identical spring-mounted individual elements that are arranged substantially parallel to each other and are secured to a carrier band, wherein said individual elements are interlaced contact bridges, wherein the carrier band comprises guide brackets that extend sideways from the carrier band, wherein the first sidewall comprises a rectangular opening having a groove configured to receive at least parts of said guide brackets or other parts of the contact elements.

15. A contact device according to claim 14, wherein the contact element protrudes over the inner surface and over the outer surface of said first sidewall.

16. A contact device according to claim 14, wherein the contact bridges extend over the inner surface and over the outer surface of said first sidewall.

17. A contact device according to claim 14, wherein the first and second sidewalls are connected by a resilient bridge element.

18. A contact device according to claim 14, wherein the width of the slot is smaller than or equal to the width of said second busbar that is placed in the slot.

19. A contact device for providing an electrical contact between a first busbar and a second busbar which are arranged substantially parallel to each other, said contact device comprising:

a holder with first and second sidewalls which extend substantially parallel to each other, wherein said sidewalls enclose a slot for receiving the second busbar, wherein each of the sidewalls comprises an inner surface facing the slot and an outer surface, wherein the first sidewall is configured to face the first busbar with its outer surface and to face the second busbar with its inner surface, and comprises a contact element for providing an electrical contact through said first sidewall from the inner surface to the outer surface thereof, and wherein the second sidewall is configured as a clip element.

20. A contact device according to claim 19, wherein the holder comprises one clip element that extends in direction of the slot over the whole length of the first sidewall.

21. A contact device according to claim 19, wherein the holder comprises at least two clip elements having a length that is shorter than the length of the first sidewall.

22. A contact device according to claim 21, wherein each clip element comprises a bulge or a cam that is arranged on the inner surface of the second sidewall.

23. A contact device according to claim 19, wherein the contact element protrudes over the inner surface and over the outer surface of said first sidewall.

24. A contact device according to claim 19, wherein the contact element comprises resilient movable contact members which protrude over the inner surface and over the outer surface.

25. A contact device according to claim 19, wherein the clip element comprises a bulger or a cam that is arranged on the inner surface of said second sidewall.

26. A unipolar busbar arrangement, comprising:

a contact device, a first busbar, and a second busbar, wherein the busbars are arranged substantially parallel to each other, wherein said first busbar and said second busbar are arranged such that there is a gap between the first busbar and the second busbar, wherein said contact device comprises a holder with first and second sidewalls which extend substantially parallel to each other, wherein said sidewalls enclose a slot for receiving the second busbar, wherein each of the sidewalls comprises an inner surface facing the slot and an outer surface, wherein the first sidewall is configured to face the first busbar with its outer surface and to face the second busbar with its inner surface, wherein said first sidewall comprises a contact element for providing an electrical contact through said first sidewall from the inner surface to the outer surface thereof, wherein the contact device is arranged for providing an electrical contact between said busbars, wherein the first sidewall of the contact device is introduceable into said gap, and wherein the holder is electrically insulating and comprises means to accommodate said contact element.

27. A bipolar busbar arrangement, comprising:

at least a first contact device and a second contact device, a first busbar, a second busbar, a third busbar, and a fourth busbar, wherein the busbars are arranged substantially parallel to each other, wherein said busbars are arranged such that there is a first gap between the first busbar and the second busbar and a second gap between the third busbar and the fourth busbar, wherein each of said contact devices comprises a holder with first and second sidewalls which extend substantially parallel to each other, wherein said sidewalls of each of said contact devices enclose a slot for receiving a busbar, wherein each of the sidewalls of each of said contact devices comprises an inner surface facing the slot and an outer surface, wherein the first sidewall of each of the contact devices is configured to face the first or the third busbar with its outer surface and to face the second or the fourth busbar with its inner surface, wherein said first sidewall of each of the contact devices comprises a contact element for providing an electrical contact through said first sidewall of each of the contact devices from the inner surface to the outer surface thereof, wherein the contact devices are arranged for providing an electrical contact between said busbars, wherein the first sidewall of the first contact device and the first sidewall of the second contact device are introduceable into said gaps.

28. A bipolar busbar arrangement, comprising:

at least a first contact device and a second contact device, a first busbar, a second busbar, a third busbar, and a fourth busbar, wherein the busbars are arranged substantially parallel to each other, wherein said busbars are arranged such that there is a first gap between the first busbar and the second busbar and a second gap between the third busbar and the fourth busbar, wherein each of said contact devices comprises a holder with first and second sidewalls which extend substantially parallel to each other, wherein said sidewalls of each of said contact devices enclose a slot for receiving a busbar, wherein each of the sidewalls of each of said contact devices comprises an inner surface facing the slot and an outer surface, wherein the first sidewall of each of the contact devices is configured to face the first or the third busbar with its outer surface and to face the second or the fourth busbar with its inner surface, wherein said first sidewall of each of the contact devices comprises a contact element for providing an electrical contact through said first sidewall of each of the contact devices from the inner surface to the outer surface thereof, wherein the contact devices are arranged for providing an electrical contact between said busbars, wherein the first sidewall of the first contact device and the first sidewall of the second contact device are introduceable into said gaps, wherein there is an insulating layer arranged between the first busbar and the third busbar and there is an insulating layer arranged between the second busbar and the fourth busbar.

* * * * *